US005578990A

United States Patent [19]

Sanford, Jr. et al.

[11] Patent Number: 5,578,990

[45] Date of Patent: Nov. 26, 1996

[54] INTRUSION DETECTION ALARMING DEVICE

[76] Inventors: Jack G. Sanford, Jr., 226 N. First St., Campbell, Calif. 95008; Jack G. Sanford, Sr., 301 California Ave., Columbus, Kans. 66725

[21] Appl. No.: 146,523

[22] Filed: Nov. 2, 1993

Related U.S. Application Data

[63] Continuation-in-part of Ser. No. 926,226, Aug. 6, 1992, abandoned.

[51] Int. Cl.[6] ..... G08B 13/00

[52] U.S. Cl. ..... 340/541; 200/85 R; 340/665

[58] Field of Search ..... 340/541, 665; 200/85 R; 256/10–12

[56] References Cited

U.S. PATENT DOCUMENTS

| | | | |
|---|---|---|---|
| 3,237,105 | 2/1966 | Kalmus | 325/29 |
| 3,696,372 | 10/1972 | Garrett et al. | 340/541 X |
| 3,950,746 | 4/1976 | Davies | 340/541 X |
| 4,064,499 | 12/1977 | Geiszler et al. | 340/258 |
| 4,155,083 | 5/1979 | Slaats et al. | 340/541 X |
| 4,365,239 | 12/1982 | Mongeon | 340/564 |
| 4,525,701 | 6/1985 | Leih | 340/541 |
| 4,533,906 | 8/1985 | Amir | 340/541 |
| 4,680,573 | 7/1987 | Ciordinik et al. | 340/541 |
| 4,683,356 | 7/1987 | Stoler | 200/61.93 |
| 4,829,286 | 5/1989 | Zvi | 340/541 |
| 4,920,331 | 4/1990 | van Themaat et al. | 340/541 |

OTHER PUBLICATIONS

Vindicator, "VTW–300 Electronics Taut Wire Fence", Aug. 1989.

*Primary Examiner*—Thomas Mullen
*Attorney, Agent, or Firm*—Patrick T. Reilly; Leary, Titus & Aiello

[57] ABSTRACT

A device that mounts on the top of each fence post along a security fence and utilizes an alarming arm which produces an electric alarm signal when moved or displaced. When a multiplicity of the units are mounted on the tops of all of the fence posts along a security fence with the alarming arms pointed outward from the fence line and barrier material is strung between the alarming arms, an extended barrier is created which increases the height of the security fence and produces an alarm when an intruder attempts to climb over the extended barrier and moves the alarming arm(s) or any member of the extended barrier supported by the alarming arm(s), thus moving the alarming arms. An extended barrier may also be installed along the top of walls by installing a plurality of devices spaced at distances approximating the spacing of fence posts along a line of security fence with barrier materials strung between the alarming arm(s). The unit(s) will automatically reset to a non alarming state when the weight is removed. The tension on the alarming arm(s) can be pre-set to accommodate heavy barrier materials such as razor ribbon concertina.

14 Claims, 4 Drawing Sheets

INTRUSION DETECTION ALARMING DEVICE

This is a continuation-in-part of application Ser. No. 07/926,226, filed Aug. 06, 1992 now abandoned.

BACKGROUND

1. Field of Invention

This invention relates to fence mounted intrusion detection devices, and has particular reference to an intrusion detection alarming device which extends the height of a security fence or security barrier and utilizes the supporting member of the extension as an alarming arm so that an alarm is triggered when weight or force is applied to any element of the extended barrier.

2. Description of Prior Art

Present intrusion detection systems have their sensing elements including trip wires mounted along security fence fabric or other security barriers and utilize the structural members of the barrier as a means of support. These same structural members can also be used as a means of support by intruders as they scale or climb over the security barrier just so long as they do not disturb the detector elements supported by the structural members.

Most of the penetration of areas protected by fences or barriers are a result of intruders scaling or climbing over the fences or barriers rather than by cutting or breaking through them. However, most of the present intrusion detection systems are mounted on the fences or barriers in a manner designed to primarily detect penetration through the center of the barrier rather than detecting a person or persons scaling or climbing over the barrier.

Present intrusion detection systems which utilize electronic detection schemes are susceptible to false alarms and require constant maintenance to make sure the fence is tight plus constant adjustment of the electronic processors in order to keep the system operational.

One class of electronic intrusion detectors register the motion of the fence fabric if a person attempts to cut through or climb over the fence. The detector elements are designed to mount on the fence fabric which exhibits more motion when the fence is disturbed than do the supporting members which are normally fence posts. U.S. Pat. No. 4,365,239 issued Dec. 21, 1982 to Ronald W. Mongeon, is representative of this type of detector which employs microphonic coaxial cable stretched longitudinally along the fence as the sensing element. Electrical noise is generated as the fence fabric is moved and this noise is processed in an attempt to distinguish the sounds generated when someone climbs the fence versus the noise generated when the fence fabric is moved by weather conditions such as wind or rain. The result is a high number of false alarms. When this system is in service, it requires constant maintenance on the fence fabric and the electronics to keep the system operational. This detector system is installed on the fence fabric which is supported by the fence posts and totally ignores the extended barrier which, when utilized, is mounted on the top of the posts by means of rigid arms. The extended barrier arm can be used by an intruder as a non alarming supporting member while he climbs over or scales the fence just so long as he does not kick the fence fabric or move it in a violent manner.

There are also other types of fence mounted intrusion detectors such as U.S. Pat. No. 3,237,105 issued Feb. 22, 1966 to Henry P. Kalmus, and U.S. Pat. No. 4,064,499. issued Dec. 20, 1977 to Theodore D. Geiszler and Ronald W. Mongeon. These systems employ long wires suspended from the fence posts which transmit and receive radio frequency energy. This energy is absorbed when a person enters the field and this change in energy level is monitored by the receiving wire and processed to annunciate an alarm. These systems also have high false alarm rates since the slightest movement of the long wires will also vary the amount of energy present at the receiver. The systems require constant maintenance to adjust the tension of the detector wires. This system totally ignores the extended barrier which is mounted on the fence posts by means of rigid arms. The rigid extended barrier arms can be used by an intruder as a non alarming supporting member as he climbs over or scales the fence. The grounded fence fabric usually shields the intruder from the detection field which is usually mounted inside the fence surrounding the protected area.

There is a mechanical system U.S. Pat. No. 4,533,906 issued Aug. 6. 1985 to Yoel Amir and U.S. Pat. No. 4,683,356 issued Jul. 28, 1987 to Aric Stoler which employs a number of long lengths of barbed wire strung longitudinally along the length of a fence and are used as trip wires. The trip wires are firmly anchored at the ends of the detection zone and the detection alarming devices are mounted in the center of the zone. An alarm is generated when one or more of the barbed wires is moved by a person attempting to climb or crawl through the barbed wire barrier. The trip wires are maintained under tension and require massive end posts making the system very expensive to install and maintain. The system is susceptible to false alarms since the trip wires are fabricated from ferric metals and have a high coefficient of expansion which results in changes in the tension of the wires under normal temperature changes from daylight to darkness. This change in tension can move the detection alarming device which will register it as an alarm. The trip wires which tie to the detection alarming devices must be supported by rigid posts. Extended barriers are normally mounted on rigid arms which can be used by an intruder as a non alarming supporting member while he climbs or scales the fence just so long as he does not put any weight or pressure on the trip wires.

All of the systems described above have a very difficult time in protecting gates with the result that gates are usually protected by detectors such as microwave or infrared systems which are not installed on the fence or barrier but are usually installed behind the fence line.

Razor ribbon concertina is sometimes employed along the top of security fences since it presents a very visible deterrent. Concertina is difficult to alarm and none of the systems described above will work as an alarm system for concertina.

OBJECTS AND ADVANTAGES

Besides the objects and advantages of the intrusion detection alarm systems described above, several objects and advantages of this invention are:

(1) to provide a simple, efficient and economical device of rugged construction that will extend the height of a security barrier and generate an electrical alarm when a person attempts to enter a protected area by climbing, scaling or crawling over the extended barrier and puts force or weight on any member supported by the alarming arm.

(2) to provide an intrusion detection alarming device that is immune to the generation of false alarms by inclement weather conditions such as wind, rain, ice and snow.

(3) to provide an intrusion detection alarming device that has a high probability of detecting an intruder who attempts to climb over or scale the extended barrier since all elements of the extended barrier along the top of the security barrier are used to produce an alarm if force or weight is applied to any element of the extended barrier.

(4) to provide an intrusion detection alarming device that is easy to install and requires little or no maintenance to remain in working order.

(5) to provide an intrusion detection alarming device having adjustable tension on the alarming arm so that heavier extended barriers, such as concertina, can be supported without reducing the sensitivity of the system or increasing the false alarm rate.

(6) to provide an intrusion detection alarming device that can be mounted on the top of swinging or sliding gates so that the extended barrier is continuous around the total perimeter of the enclosed area when the gates are closed. This is accomplished by mounting the intrusion detection alarming devices and extended barriers on the gates higher than the units mounted on the fence. Swinging gates and sliding gates can then be opened and closed without colliding with the devices mounted on the fences.

The means by which the foregoing and other objects are accomplished and the method of the accomplishment will readily be understood from the following specification upon reference to the accompanying drawings.

DRAWING FIGURES

REFERENCE NUMERALS IN DRAWINGS

Figure 1:
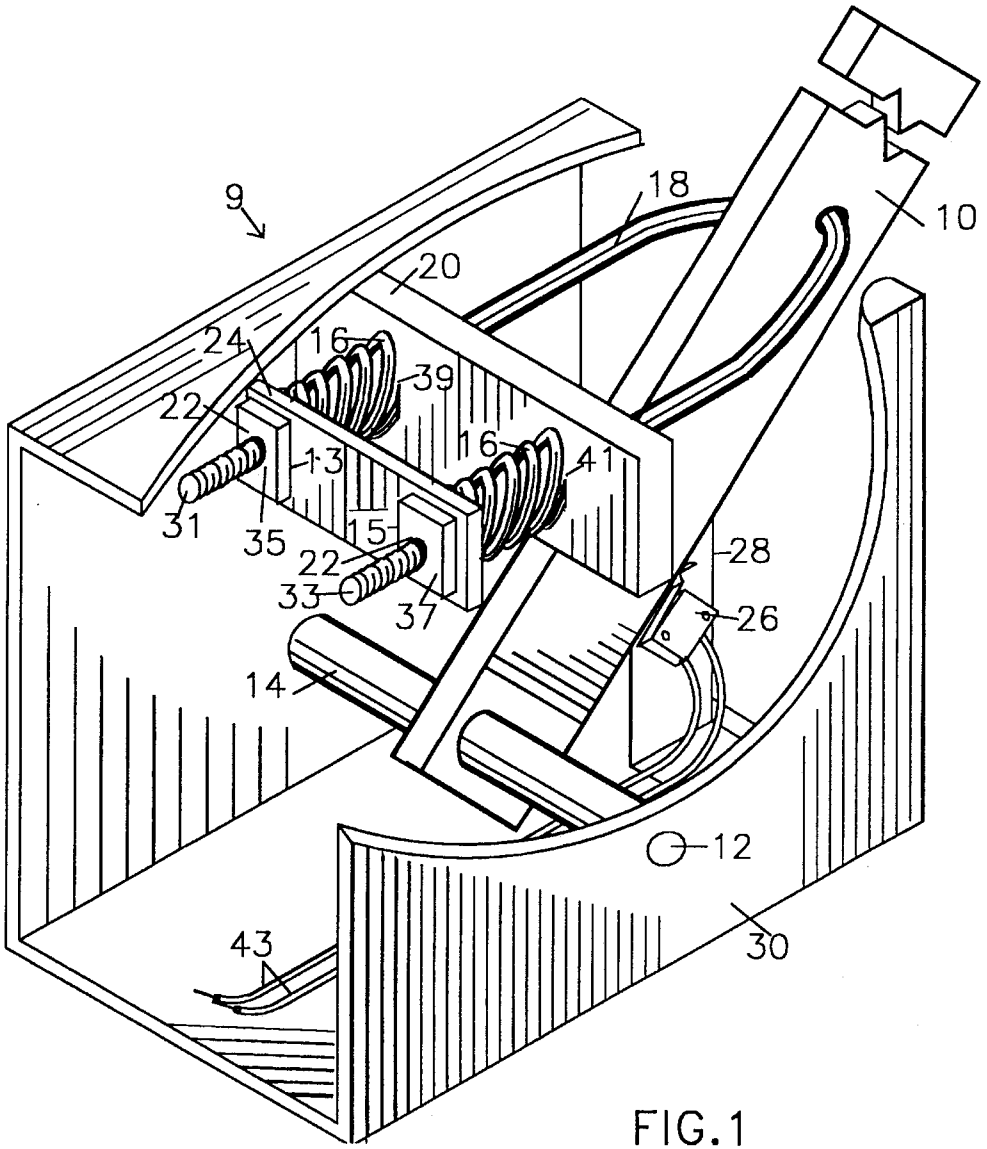
FIG. 1 is an isometric view of the intrusion detection alarming device.

9 intrusion detection device
10 alarming lever arm
12 shaft
13,15 access holes of tension plate
14 spacer bushing
16 tensioning device or spring
18 tensioning member
20 tensioning bracket or fixed plate
22 tensioning adjustment device
24 tensioning plate or tensioning adjustment plate
26 electrical contacting device
28 electrical contacting device mounting bracket
30 intrusion detection alarming device housing
31, 33 ends of tensioning member
35, 37 nuts
39, 41 access or through hole of tensioning bracket
43 sensor state signal transmission means
45 barrier material
46 base connection
48 post
50 security fence fabric

DESCRIPTION-FIG. 1

Figure 2:
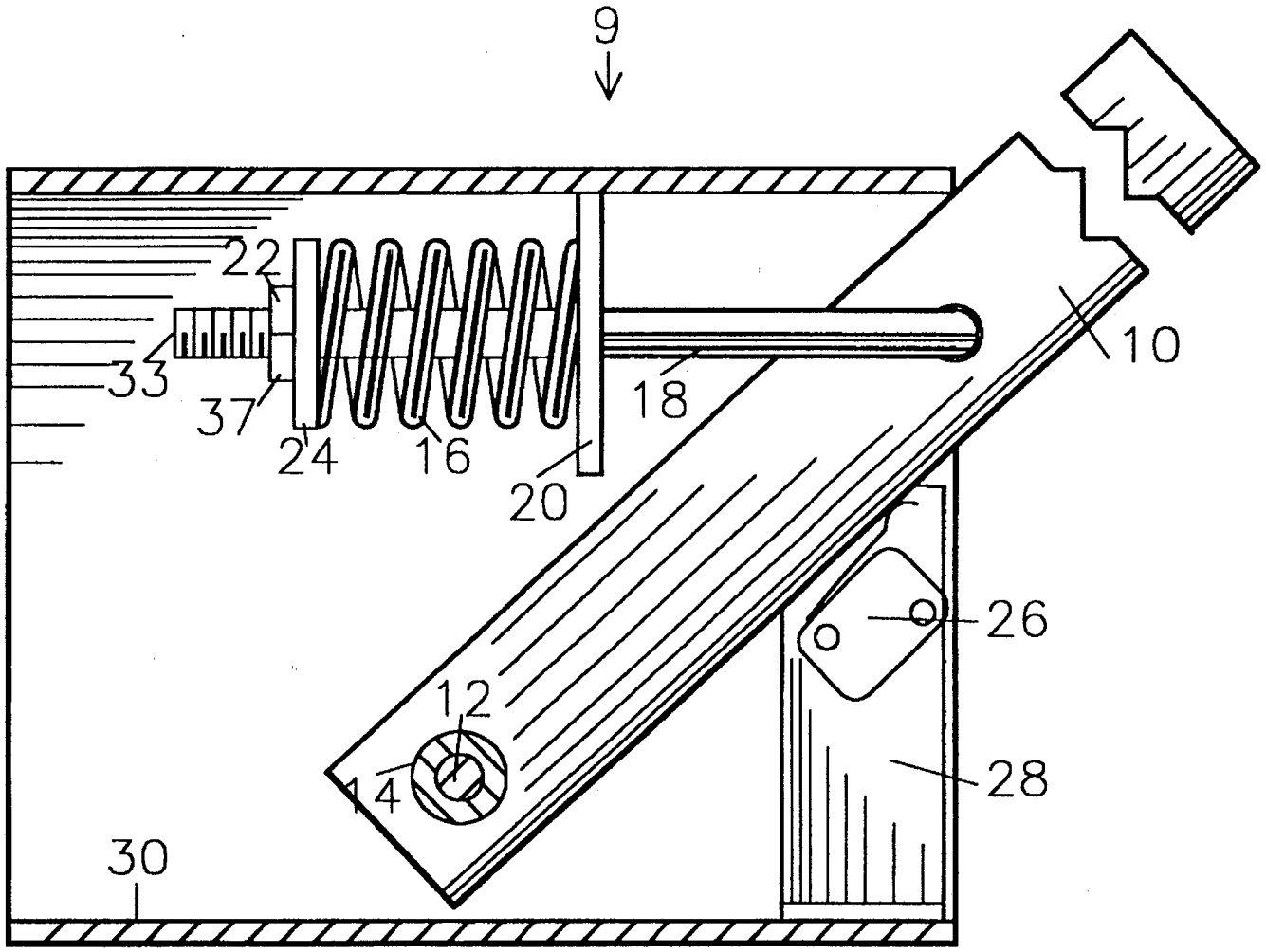
FIG. 2 is a section view.
Figure 3:
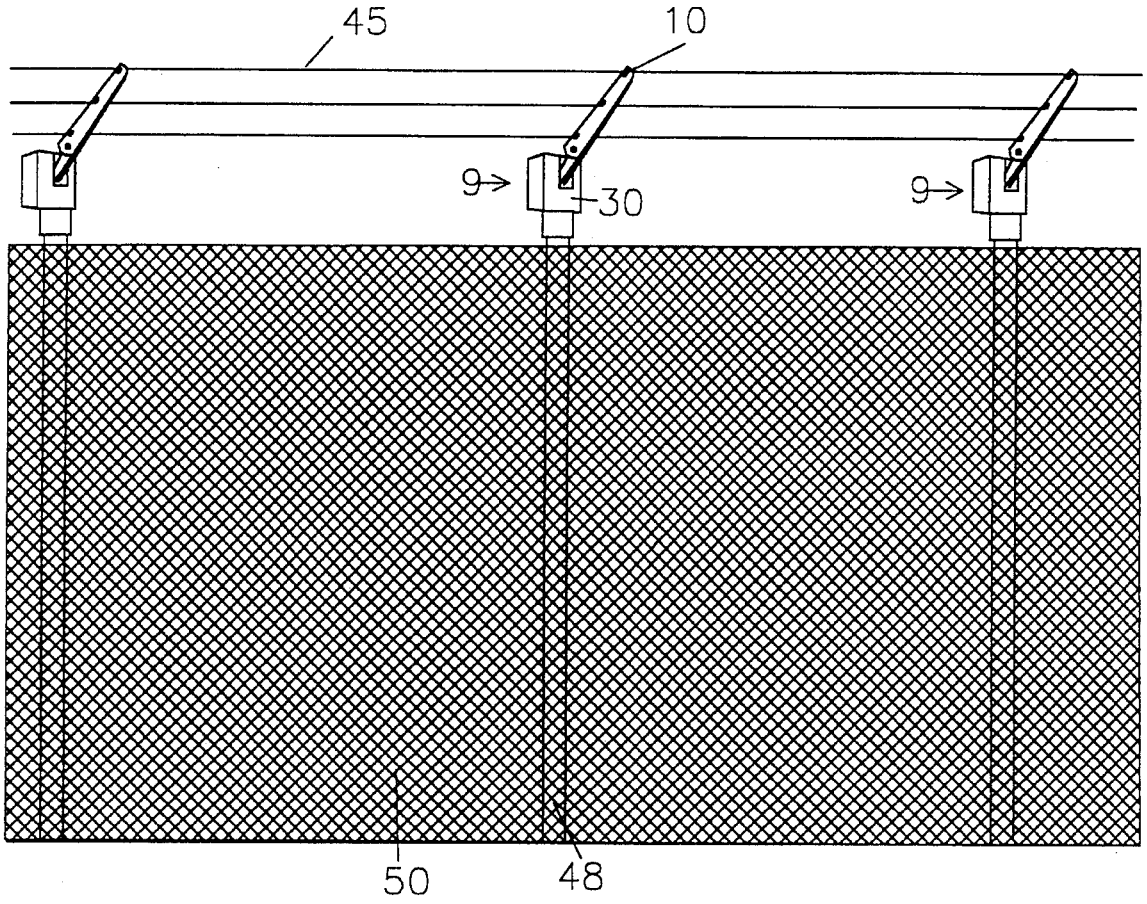
FIG. 3 is a pictorial view of a section of security fence equipped with intrusion detection alarming devices where the alarming arms support an extended barrier composed of barbed wire suspended between the alarming arms.

Figures 1–3 show the intrusion detection device 9. Referring to FIG. 1, an alarming lever arm 10 is supported by a shaft 12 in such a manner that it will freely rotate about the shaft and is centered by spacer bushings 14 which are installed around the shaft.

Tension is applied to the alarming lever arm 10 by tensioning devices, springs, 16 which are anchored to the intrusion detection alarming device housing 30 by a tensioning bracket 20 so that tension is transmitted by a tensioning member 18 which is fitted with a tensioning plate 24 and tensioning adjustment devices 22 so that tension can be increased or decreased as desired. In the preferred embodiment disclosed in FIG. 1, tensioning member 18 comprises a U shaped bolt having two distinct ends 31 and 33. Each end 31 and 33 passes through an access or through hole 39 or 41 of tensioning bracket or fixed plate 20, a spring 16, an access hole 13 or 15 of tensioning plate or tensioning adjustment plate 24 and a nut 35 or 37.

An electrical contacting device 26 is mounted near the alarming lever arm 10 and is supported by an electrical contacting device mounting bracket 28 so that a predetermined amount of movement of the alarming lever arm 10 will result in the generation of an alarm signal. Sensor state signal transmission means 43 communicates the instantaneous condition of the electrical contacting device 26 through standard electrical signal wire. In alternate preferred embodiments, sensor state transmission means may be one of the following: metallic wire, electrical signal wire or cabling, fiber optic wire, or the like. In alternate preferred embodiments of the present invention the electrical contacting device 26 may be one of the following: electrical switches, electronic switches, micro-switches, optical switches or similar components.

The intrusion detection alarming device housing 30 is a heavy metal rectangular box which will be fitted with various adaptors for mounting on top of security fence posts, solid fences, walls, etc.

OPERATION-FIGS. 2, 3

FIG. 2 is a sectional view along section A—A of FIG. 1 When weight or force is applied to the end of the alarming lever arm 10 and is sufficient to overcome the restraining force applied to the alarming lever arm 10 by the combination of the tensioning device 16, tensioning member 18, tensioning bracket 20, tensioning adjustment device 22, and tensioning plate 24, then the alarming lever arm 10 will move enough to actuate the electrical contacting device 26 and generate an alarm signal.

Figure 4:
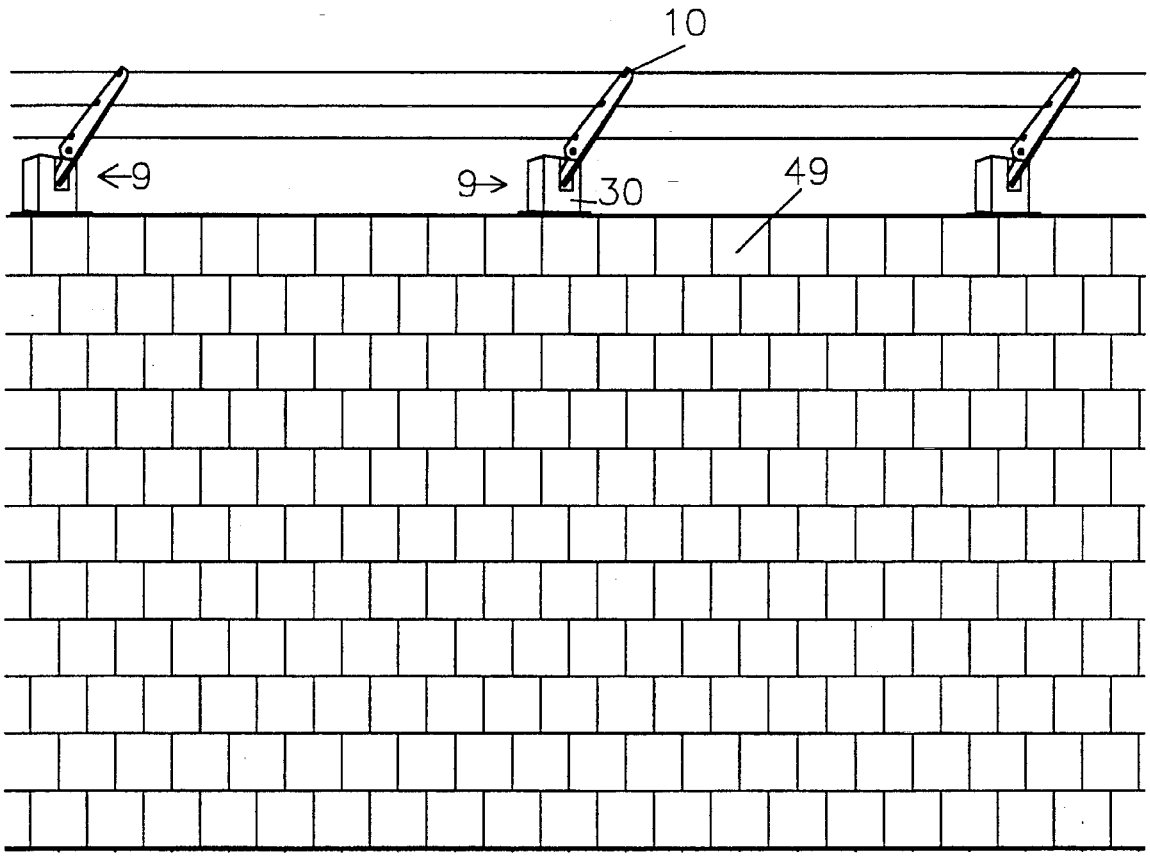
FIG. 4 is a front view of the intrusion detection alarming device installed atop a wall.

The present invention 9 can be supported by alarming lever arm 10. The present invention 9 can be mounted onto a post 48, a wall 49 as shown in FIG. 4, or a security fence fabric 50.

Tension on the alarming arm 10 can be increased or decreased by tightening or loosening the tensioning adjustment devices 22 so that heavier loads such as razor ribbon concertina can be installed between adjacent alarming arms to form an alarming barrier without increasing the susceptibility to false alarms due to weather conditions while maintaining the over-all sensitivity of the system.

The intrusion detection alarming device is shown in FIG. 3 mounted to the top of a security fence. Alarming lever arm 10 extends from the intrusion detection alarming device housing 30 and supports barbed wire which in this case makes up the extended barrier.The present invention can be attached or connected to a physical structure such as a wall, a post or a multiplicity of posts, and/or a security fence fabric.

An electric alarm signal will be generated when a person or persons attempt to climb, scale or crawl over the extended barrier and applies force to any element supported by the alarming lever arm 10 of said intrusion detection alarming device.

The elements of said extended barrier are not limited to barbed wire as shown in Fig.3 but can be composed of other security barrier materials such as razor ribbon, razor ribbon concertina, barbed wire concertina, or a fine mesh anti-climb woven wire fence barrier material.

What is claimed is:

1. An intrusion detection alarming device comprising:

a base;

said base being connected to a physical structure;

an alarming lever arm comprising an inner and an outer end, said inner end being pivotally attached to said base for rotational deflection;

a barrier material wherein said barrier material is a material selected from the group consisting of wire, barbed wire, razor ribbon, razor ribbon concertina, barbed wire concertina, and woven wire mesh;

said barrier material being attached to and supported by said alarming lever arm;

a tension means comprising a first end and a second end, said first end attached to said base and said second end attached to said alarming lever arm;

an electronic sensor means affixed to said base for detecting rotational deflection of said alarming lever arm;

said alarming lever arm having a first state and a second state, said first state occurring when said tension means is restraining the rotational deflection of said alarming lever arm about said inner end and said electronic sensor means is not detecting rotational deflection of said alarming lever arm;

said second state occurring when said tension means is extended due to the addition of force or weight applied to said barrier material or said alarming lever arm by an intruder , causing said alarming lever arm to be rotationally deflected about said inner end, whereby said electronic sensor means detects said rotational deflection of said alarming lever arm; and a sensor state signal transmission means extending from said electronic sensor means.

2. The device of claim 1, wherein said physical structure is a post.

3. The device of claim 1, wherein said physical structure is a wall.

4. The device of claim 1, wherein said physical structure is security fence fabric.

5. The device of claim 1 wherein said electronic sensor means is a sensor selected from the group consisting of electrical switches, electronic switches, micro-switches and optical switches.

6. The device of claim 1 wherein said sensor state signal transmission means extending from said electronic sensor means is a transmission means selected from a group consisting of metallic wire, electrical signal cabling and fiber optic wire.

7. An intrusion detection alarming device comprising:

a base housing;

said base housing being connected to a physical structure:

an alarming lever arm comprising an inner and an outer end, said inner end being transversely attached to a shaft;

said shaft being attached to said base housing;

a barrier material selected from the group consisting of wire, barbed wire, razor ribbon, razor ribbon concertina, barbed wire concertina, and woven wire mesh;

said barrier material being attached securely to and supported by said alarming lever arm;

a tensioning member comprising a U-shaped bolt, a fixed plate, a first spring and a second spring, a first nut and a second nut, and a tensioning adjustment plate;

said U-shaped bolt comprising a first end and a second end;

said U-shaped bolt attached to said alarming lever arm;

said fixed plate attached to said base housing;

said fixed plate comprising a first through hole and a second through hole;

said tensioning adjustment plate comprising a first access hole and a second access hole;

said U-shaped bolt first end passing through said first through hole, through said first spring, through said first access hole and captured in place by said first nut;

said U-shaped bolt second end passing through said second through hole, through said second spring, through said second access hole and captured in place by said second nut;

said tensioning member applying a tension to said alarming lever arm;

an electronic sensor means affixed to said base housing and detecting rotational deflection of said alarming lever arm;

said alarming lever arm having a first state and a second state, said first state occurring when said tension means is restraining the rotational deflection of said alarming lever arm about said inner end and said electronic sensor means is not detecting rotational deflection of said alarming lever arm;

said second state occurring when said tension means is extended due to the addition of force or weight applied to said barrier material or said alarming lever arm by an intruder , causing said alarming lever arm to be rotationally deflected about said inner end , whereby said electronic sensor means detects said rotational deflection of said alarming lever arm; and an electronic sensor means signal transmission means comprising electrical signal wire extending from said electronic sensor means.

8. The device of claim 7, wherein said physical structure is a post.

9. The device of claim 7, wherein said physical structure is a wall.

10. The device of claim 7, wherein said physical structure is security fence fabric.

11. The device of claim 7 wherein said electronic sensor means is a sensor selected from the group consisting of electrical switches, electronic switches, micro-switches and optical switches.

12. In combination:

a barrier structure;

a multiplicity of intrusion detection alarming devices, each of said devices comprising:

a base;

said base being connected to a physical structure;

an alarming lever arm comprising an inner and an outer end, said inner end being directly and pivotally attached to said base for rotational deflection;

a barrier material wherein said barrier material is a material selected from the group consisting of wire, barbed wire, razor ribbon, razor ribbon concertina, barbed wire concertina, and woven wire mesh;

said barrier material being attached securely to and supported by said alarming lever arm;

a tension means comprising a first end and a second end, said first end attached to said base and said second end attached to said alarming lever arm;

an electronic sensor means affixed to said base and detecting rotational deflection of said alarming lever arm;

said alarming lever arm having a first state and a second state, said first state occurring when said tension means is restraining the rotational deflection of said alarming lever arm about said inner end and said electronic sensor means is not detecting rotational deflection of said alarming lever arm;

said second state occurring when said tension means is extended due to the addition of force or weight applied to said barrier material or said alarming lever arm by an intruder, causing said alarming lever arm to be rotationally deflected about said inner end , whereby said electronic sensor means detects said rotational deflection of said alarming lever arm; and a sensor state signal transmission means extending from said electronic sensor means.

13. The combination of claim 12 wherein said electronic sensor means is a sensor selected from the group consisting of electrical switches, electronic switches, micro-switches and optical switches.

14. The combination of claim 12 wherein said sensor state signal transmission means extending from said electronic sensor is a transmission means selected from a group consisting of metallic wire, electrical signal cabling and fiber optic wire.

* * * * *